United States Patent [19]

Commault et al.

[11] 4,139,828

[45] Feb. 13, 1979

[54] TRANSITION DEVICE BETWEEN A COAXIAL LINE AND A WAVE-GUIDE

[75] Inventors: Yves Commault; Yves Campan, both of Paris, France

[73] Assignee: Thomson-CSF, Paris, France

[21] Appl. No.: 816,202

[22] Filed: Jul. 15, 1977

[30] Foreign Application Priority Data

Jul. 20, 1976 [FR] France ..... 76 22141

[51] Int. Cl.[2] ..... H01P 5/10

[52] U.S. Cl. ..... 333/26; 333/35

[58] Field of Search ..... 333/21 R, 26, 33, 35

[56] References Cited

U.S. PATENT DOCUMENTS

| | | | |
|---|---|---|---|
| 2,943,275 | 6/1960 | Bittner et al. | 333/26 |
| 3,758,886 | 9/1973 | Landry et al. | 333/33 X |
| 3,969,691 | 7/1976 | Saul | 333/21 R |

*Primary Examiner*—Paul L. Gensler

*Attorney, Agent, or Firm*—Cushman, Darby & Cushman

[57] ABSTRACT

The invention covers transition devices between a coaxial line and a wave-guide. The central core of the coaxial line enters a transverse partial partition in the wave-guide through an opening in it. The core continues in the wave-guide at the level of the partial partition and promotes the passage from an odd TEM type mode to an even, type TE 10, mode and vice versa.

6 Claims, 7 Drawing Figures

TRANSITION DEVICE BETWEEN A COAXIAL LINE AND A WAVE-GUIDE

Figure 1:
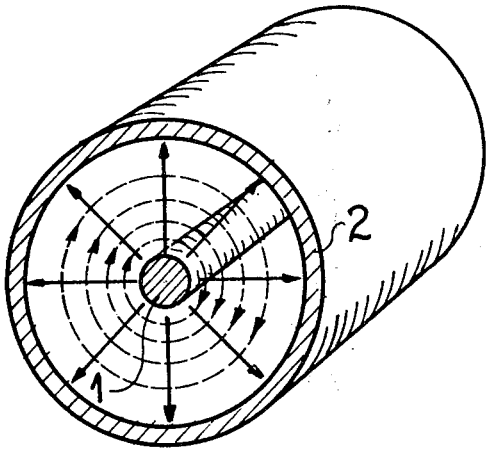

The invention concerns transition devices between a coaxial line and a wave-guide.

The importance of such transitions is explained by the fact that the transmission of energy of a microwave signal takes place through distributed constant circuits among which are the coaxial line and the wave-guide. However, these two types of transmission line differ in their structure, their physical properties and their technical possibilities. A choice of either one or the other of line is made as a function of the application being considered. Later a switch or a transition between a coaxial line and a wave-guide may be imposed when the technical reasons for a choice are not the same in the various parts of a microwave circuit assembly.

A coaxial line is characterized by having a concentric construction with two conductors. The propagation mode used the most is the TEM mode. In a cross-section, the electric field is odd for any diameter and the magnetic field lines are concentric circles.

In a wave-guide, whose structure is quite different from that of a coaxial line, wave propagation can take place in different modes; however the fundamental mode is the most used. In a rectangular wave-guide for example, the electric and magnetic field lines in a cross-section are rectilinear and the fields have an even distribution for the fundamental mode.

The best known transition shape is the one which consists in energizing the wave-guide crosswise by means of an extension of the coaxial line core. The extension, called a coupling "stub", may have various shapes. It may be covered with a dielectric or be terminated in a "door-knob" or a "cross". In the last two cases, the stub places the coaxial line core in electrical contact with the wave-guide's metallic walls.

For more detailed information on the structure of waveguides, lines and their transitions, the "wave-guide Handbook" in the M.I.T. collection and "Microwave Engineering" by A. F. Harvey (Academic Press, London & New York) can be consulted.

A major drawback of present transitions results from the fact that these transitions are of the transverse type in the sense that the coaxial line joins the wave-guide crosswise. The volume of such transitions is a drawback in the case of airborne or space equipments for example. The way to avoid this is to energize the wave-guide longitudinally from the coaxial line. The problem then consists in terminating the coaxial line core to a wave-guide wall so as to form a loop. However, this transition has drawbacks, on the one hand those of the loop profile to be respected and on the other those of an electrical contact to be set up by soldering between the end of the coaxial core and the wave-guide which prevents disassembly. Such a solution also causes difficulties in industrial production and its reproductiveness is uncertain.

The transition in accordance with the invention has not got these drawbacks. It remains very simple with resulting advantages (ease of industrial production, reproductiveness). It is a transition of the longitudinal type taking up a minimum of space.

In accordance with the invention, there is provided a longitudinal transition device for coupling a coaxial transmission line having a central core and an external conductor, and a wave-guide, comprising a transverse partition for filling at least partly a section of the wave-guide, an adjacent cavity coupled to the wave-guide, near said transverse partition, said transverse partition comprising an opening by which the coaxial line central core is introduced and extends rectilinearly in the wave-guide, the central core axis being substantially parallel to and offset with respect to the wave-guide axis and the coaxial line external conductor being electrically connected to said partition.

In this transition, no electrical contact between the coaxial guide core and the wave-guide walls is required. The fact that the stub is rectilinear makes it possible to produce transitions that can be taken apart. The assembly can be reduced to simply plugging simplicity of the production of this transition and its reproductiveness enable low manufacturing costs to be obtained.

Features and advantages of the invention will appear from the following description which is illustrated by the figures which show:

FIG. 1: a section of coaxial line

Figure 2:
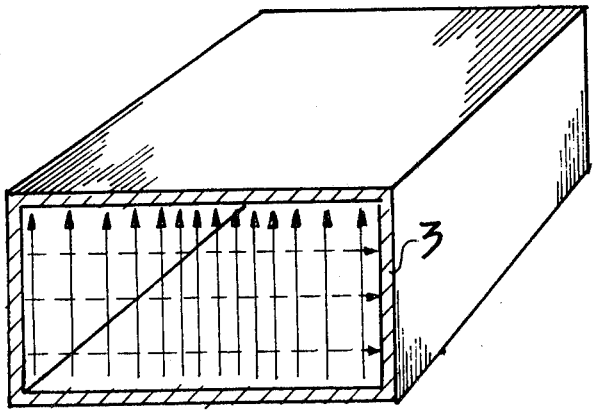

FIG. 2: a section of wave-guide

Figure 3:
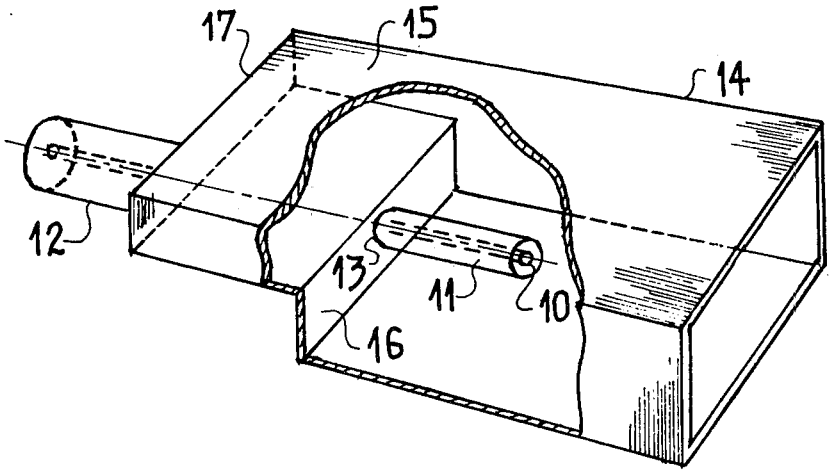

FIG. 3: an exploded view of a transition in accordance with the invention

Figure 4:
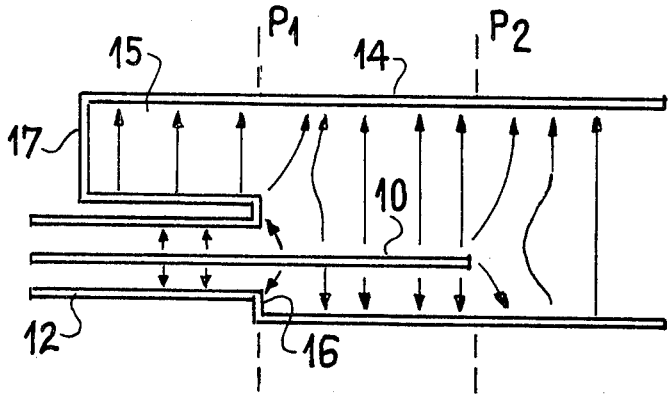
Figure 5A:
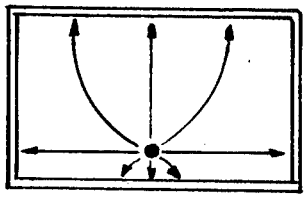
Figure 5B:
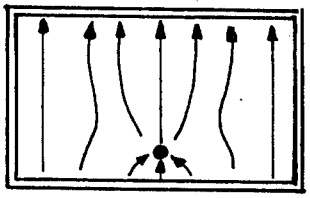
Figure 6:
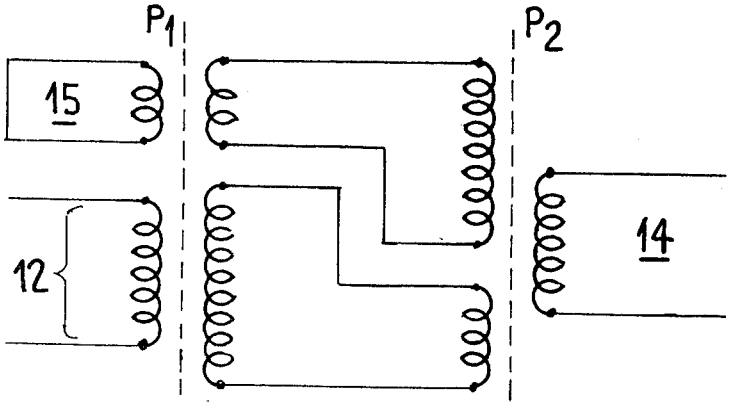

FIG. 4: a longitudinal section of the transition in accordance with the invention FIG. 5 (a and b): cross-section views FIG. 6: the transition equivalent circuit.

FIG. 1 shows a section of coaxial line and more especcially a straight section of such a guide with the electric and magnetic field lines. It is a structure formed by two concentric conductors: a central conductor 1 or core and an external conductor 2. In accordance with the crosswise dimensions of this line and especially those of external conductor 2, different types of propagation are possible. The most often used is the TEM mode which is characterized by the absence of cut-off wave-length. In the straight section, the electric field lines follow radii (continuous line arrows) while the magnetic field lines follow concentric circles (dotted line circles). The electric field is odd along a diameter, this being due to the symmetry of revolution of the coaxial structure.

FIG. 2 shows a wave-guide structure. It is a structure formed by a single tubular conductor 3 and propagation takes place inside it. Depending on the shape and transverse dimensions of the wave-guide, various types of propagation are possible. For all types of guides, propagation in the fundamental mode is characterized by a cut-off wave-lengyh $\lambda_c$ fixed by the section and nature of the internal medium.

The most common wave-guide has a rectangular cross-section. The fundamental mode is the TE 10 mode which, in a cross-sectional plane, has an even electric field parallel to the wave-guide side walls. The electric field is shown in FIG. 2 by continuous line arrows and the magnetic field by dotted line arrows.

Other types of wave-guide are known; their cross-sections may be circular, elliptical, triangular, etc. They may have one or several internal ribs ("ridged" guides) or an internal dielectric to encourage fundamental mode propagation.

FIG. 3 shows an exploded view of a transition in accordance with the invention between a coaxial line and a rectangular wave-guide.

It is a longitudinal transition, i.e. the coaxial line axis and the wave-guide axis are substantially the same or parallel.

The coaxial guide consists of a core 10 and an external conductor 12. A hole 13 is made in a partial transverse partition 16 in the wave-guide 14 to allow the entry of core 10. The external conductor 12 is electrically connected to the partition 16. Core 10 is covered by a dielectric 11 in order to insulate it from partition 16 and external conductor 12. Its penetration into wave-guide 14, which is an adjustment parameter, is of the order of a quarter wave-length.

The axis of core 10 cannot be exactly the same as the axis of the guide because the odd distribution of the field at the core level would not allow the wave-guide to be energized in the fundamental mode. Only odd modes with a cut-off would be produced whereas the wave-guide dimensions are such that only the fundamental mode can exist.

Coupling between the odd TEM mode of the coaxial line and the even fundamental mode of the wave-guide is obtained by offsetting the coaxial line axis with respect to that of the wave-guide.

However, this asymmetry does not cause adequate energizing and also matching the impedances of one line to the other is difficult because of the difference in their respective characteristic impedances on the one hand and the low coupling rate between waves with odd and even distributions on the other.

Coupling is increased by the presence of a cavity 15 adjacent to the coaxial line 12 and offset with respect to the connection area 16. This cavity may be formed by an extension of guide 14 beyond transverse partition 16 above the coaxial line and due to the offsetting of the latter. The section is then less than that of the wave-guide.

For the adjustment of such a transition, several parameters, which can be varied easily, are available. For example, the length of core 10 which enters the guide, the length of the adjacent cavity or the height of this cavity.

One way of producing such a transition has shown that the length of the core in the guide and that of the adjacent cavity are roughly equal to a quarter wave-length. As for the cavity height, about half the wave-guide height must be allowed. The orders of size given are not be considered as limiting.

The field lines inside the transition are shown approximately in the sectional views of FIGS. 4 and 5.

The existence of an asymmetry at the transition level causes at least a local existence of odd and even modes. Outside the transition, only one mode type can exist: the even fundamental mode TE 10 in the wave-guide (if this is rectangular, but TE 11 if it is circular) and the odd TEM mode in the coaxial line.

In the transition, the existence of two types of mode, odd and even, is possible over an extensive area. FIG. 4 shows that a disymmetry in field distribution continues along the coaxial core extension. This can be interpreted as the superimposition of an odd mode, shown in FIG. 5 (*a*), and even mode, shown in FIG. 5 (*b*). This superimposition exists in the section of line formed by an external conductor corresponding to the coaxial core extension.

This transition then has two connection areas between different types of propagation mode. One, plane P1, shown in FIG. 4, corresponds to partition 16 (FIG. 3), i.e. to the passage from the coaxial TEM mode to an intermediate section in which odd and even modes exist at the same time in the coupling with rear cavity 15. The other is the plane P2 corresponding to the passage from the intermediate section to the wave-guide 14.

Such a coupling and transfer process corresponds to the equivalent schematic diagram shown in FIG. 6. Coaxial line 12 and cavity 15 on one side of plane P1, wave-guide 14 on one side of plane P2 and the intermediate section between planes P1 and P2 can be found. From what precedes, it can be seen that the most accessible adjustment parameters are the length of the intermediate section or penetration of core 10 of the coaxial line in the wave-guide on the one hand and the depth of cavity 15 with which the value of the reactance referred to plane P1 can be adjusted on the other. As the line lengths are small (about a quarter wave-length), matching varies little with frequency. The results obtained are comparable with those of classical transverse transitions. Contact between the coaxial core and the wave-guide is not necessary. In a pratical example of production, coaxial core 10 is covered with dielectric. The coaxial is a classical commercial connector. This shows the ease of manufacture and hence the low costs of industrial production and high reproductiveness.

This new type of transition is applicable in all cases in which its longitudinal structure is well adapted to thin microwave assemblies (micro-circuits). Instead of a coaxial line, it is also possible to use a microstrip type ribbon line, the TEM mode in such a line being very close to that of a coaxial line. There is then no difference in operation and adjustment.

The wave-guide section may be rectangular, circular, elliptical, etc., have ridges or be filled with dielectric and still keep within the framework of the invention. Generally, cavity 15 is only the partial extension of wave-guide 14 but, for sections other than rectangular, it may be necessary to add a central rib to allow propagation. In the same way, if the wave-guide, no matter what its section, is filled with dielectric, the cavity must be too.

The extension of the coaxial core may be of more complex shape than those shown in the figures without the theory and operation of the transition being modified.

What is claimed is:

1. A longitudinal transition device for coupling a coaxial transmission line having a central core and an external conductor, and a wave guide, comprising a transverse partition for filling at least partly a transverse section of the wave guide, an adjacent cavity coupled to the wave guide, near said transverse partition, said transverse partition comprising an opening by which the coaxial line central core is introduced and extends rectilinearly in said wave guide, said central core axis being substantially parallel to and offset with respect to the wave guide axis and said coaxial line external conductor being electrically connected to said partition, said cavity extending said wave guide on the same side as said coaxial line with respect to said transverse partition.

2. A longitudinal transition device for coupling a coaxial transmission line having a central core and an external conductor, and a wave guide, comprising a transverse partition for filling at least partly a transverse section of the wave guide, an adjacent cavity coupled to the wave guide, near said transverse partition, said transverse partition comprising an opening by which the coaxial line central core is introduced and extends rectilinearly in said wave guide, said central core axis being substantially parallel to and offset with respect to the wave guide axis and said coaxial line external conductor being electrically connected to said partition, said cavity extending said wave guide on the same side as said coaxial line with respect to said transverse partition, the transverse section of the adjacent cavity being smaller than that of said wave guide and equal to the difference between that of said wave guide and the surface of said partial transverse partition.

3. A longitudinal transition device for coupling a coaxial transmission line having a central core and an external conductor and a wave guide, comprising a transverse partition for filling at least partly a transverse section of the wave guide, an adjacent cavity coupled to the wave guide, near said transverse partition, said transverse partition comprising an opening by which the coaxial line central core is introduced and extends rectilinearly in said wave guide, said central core axis being substantially parallel to and offset with respect to the wave guide axis and said coaxial line external conductor being electrically connected to said partition, said cavity extending said wave guide on the same side as said coaxial line with respect to said transverse partition, the transverse section of the adjacent cavity being smaller than that of said wave guide.

4. A longitudinal transition device as claimed in claim 3, wherein the length of said adjacent cavity is adjustable and variable about a quarter wave-length.

5. A longitudinal transition device as claimed in claim 3, wherein the length of said center core extension of said coaxial line is adjustable and variable about a quarter wave length.

6. A longitudinal transition device as claimed in claim 3, wherein said center core is covered with dielectric material.

* * * * *